US010694862B2

(12) United States Patent
Fischer et al.

(10) Patent No.: US 10,694,862 B2
(45) Date of Patent: Jun. 30, 2020

(54) MATTRESS PROTECTOR WITH REMOVABLE TOP AND HAVING SIDE SUPPORTS

(71) Applicant: American Textile Company, Duquesne, PA (US)

(72) Inventors: Jane Fischer, Mooresville, NC (US); Patrick Seiffert, Duquesne, PA (US)

(73) Assignee: American Textile Company, Inc.

( * ) Notice: Subject to any disclaimer, the term of this patent is extended or adjusted under 35 U.S.C. 154(b) by 544 days.

(21) Appl. No.: 15/403,234

(22) Filed: Jan. 11, 2017

(65) Prior Publication Data

US 2018/0192782 A1 Jul. 12, 2018

(51) Int. Cl.

| | |
|---|---|
| ***A47C 31/00*** | (2006.01) |
| ***A47C 31/10*** | (2006.01) |
| ***A47C 27/00*** | (2006.01) |

(52) U.S. Cl.

CPC ..... *A47C 31/007* (2013.01); *A47C 27/005* (2013.01); *A47C 27/008* (2013.01); *A47C 31/105* (2013.01)

(58) Field of Classification Search

CPC ... A47C 31/007; A47C 31/105; A47C 27/005; A47C 27/008; A47G 9/0246; A47G 9/04

See application file for complete search history.

(56) References Cited

U.S. PATENT DOCUMENTS

| | | | | | |
|---|---|---|---|---|---|
| 2,630,588 | A * | 3/1953 | Levin | A47C 31/105 | 5/496 |
| 4,549,323 | A | 10/1985 | Brockhaus | | |
| 4,754,514 | A | 7/1988 | Limb et al. | | |
| 4,891,856 | A | 1/1990 | Thornhill | | |
| 4,914,761 | A * | 4/1990 | Boyd | A47C 27/085 | 156/157 |
| 4,922,565 | A * | 5/1990 | Blake | A47C 27/005 | 5/484 |
| 5,113,541 | A * | 5/1992 | Johenning | A47C 27/085 | 156/297 |
| 5,136,741 | A * | 8/1992 | Balonick | A47C 27/001 | 5/699 |
| 5,479,664 | A * | 1/1996 | Hollander | A47G 9/0246 | 5/497 |
| 5,557,813 | A * | 9/1996 | Steed | A47C 27/001 | 5/678 |
| 6,035,469 | A * | 3/2000 | Schrougham | A47G 9/0292 | 5/493 |

(Continued)

*Primary Examiner* — Peter M. Cuomo
*Assistant Examiner* — Alexis Felix Lopez
(74) *Attorney, Agent, or Firm* — H. Jay Spiegel

(57) ABSTRACT

A mattress protector completely encloses a mattress. The top wall is removable from the side walls by operating a zipper. The zipper includes protective features designed to prevent bed bugs from leaving the interior of the mattress protector via the zipper slide. When the top wall is removed from the side walls, the present invention includes supports for the side walls so that when the top wall is removed, the side walls remain erect so that the top wall can easily be reattached by placing the top wall over the top surface of the mattress and then operating the zipper around the side walls to reattach the top wall. A number of different embodiments of structures designed to hold the side walls upright when the top wall is removed are disclosed.

34 Claims, 20 Drawing Sheets

(56) References Cited

U.S. PATENT DOCUMENTS 6,859,962 B2 * 3/2005 Diak/Ghanem ..... A47G 9/02 5/484
7,007,325 B1 * 3/2006 Gomeh ..... A47C 21/022 5/496
7,047,580 B2 5/2006 Finn
7,168,113 B1 * 1/2007 Olsen ..... A47G 9/0284 5/482
7,930,779 B2 4/2011 Marrache
8,347,430 B2 1/2013 Malouf et al.
8,898,834 B1 * 12/2014 Huber ..... A47C 31/105 5/482
2003/0177579 A1 * 9/2003 Diak/Ghanem ..... A47G 9/02 5/499
2005/0132498 A1 * 6/2005 Vrionis ..... A47C 27/005 5/737
2007/0067916 A1 3/2007 Poston
2008/0044580 A1 2/2008 Marte et al.
2008/0214075 A1 * 9/2008 Marte ..... D06M 10/006 442/80
2009/0205134 A1 * 8/2009 Wootten, Jr. ..... A47G 9/0246 5/488
2009/0241261 A1 10/2009 Sack
2010/0107337 A1 5/2010 Taylor
2010/0154119 A1 * 6/2010 Shuttleworth ..... A47C 21/06 5/484
2011/0250409 A1 * 10/2011 Marte ..... D06M 11/79 428/195.1
2011/0308013 A1 * 12/2011 Kennett ..... A47C 31/10 5/493
2012/0084918 A1 * 4/2012 Rattner ..... A47C 31/105 5/500
2012/0117728 A1 * 5/2012 O'Neill ..... A47C 31/007 5/499
2012/0137434 A1 * 6/2012 Dusaj ..... A47C 31/007 5/499
2013/0117935 A1 * 5/2013 Rensink ..... A47C 31/007 5/499
2014/0317845 A1 10/2014 Smith
2015/0053317 A1 * 2/2015 Fan ..... A47C 31/105 150/158
2015/0074906 A1 3/2015 Hiatt et al.
2016/0157625 A1 * 6/2016 Schneider ..... A47C 27/006 5/699
2016/0331160 A1 * 11/2016 Rattner ..... A47C 31/007

* cited by examiner a-hook similar to removable bra straps

MATTRESS PROTECTOR WITH REMOVABLE TOP AND HAVING SIDE SUPPORTS

BACKGROUND OF THE INVENTION

The present invention relates to a mattress protector with removable top and having side supports. In the prior art, it is known to completely enclose a mattress with a protective cover that seals the mattress from incursion of moisture or dirt or stains and at the same time precludes bed bugs or other insects living in or on the mattress from escaping the mattress protector.

More often than not, such enclosing mattress protectors are made of a fluid impervious material and have no provision for a top wall that provides comfort and resiliency. Such features are typically provided on structures attached over an enclosing mattress protector.

It is also known to provide such a mattress protector with a removable top wall. However, Applicants are unaware of any such device which facilitates maintaining the side walls of the mattress protector upright when the top wall has been removed for washing. Rather, when the top wall is removed, the side walls collapse, thereby making it more difficult to reinstall the top wall after washing.

It would be advantageous if a mattress protector could be provided which not only is fluid impervious and prevents exit of bed bugs or other insects but also includes a removable top wall that incorporates a mattress pad therein and wherein the side walls of the mattress protector remain upright when the top wall is removed.

Applicants are aware of the following prior art:

U.S. Patents

| |
|---|
| 4,549,323 to Brockhaus |
| 4,754,514 to Limb et al. |
| 4,891,856 to Thornhill |
| 5,479,664 to Hollander |
| 7,047,580 to Finn |
| 7,930,779 to Marrache |
| 8,347,430 to Malouf et al. |

U.S. Published Applications

| |
|---|
| 2007/0067916 to Poston |
| 2009/0241261 to Sack |
| 2010/0107337 to Taylor |
| 2010/0154119 to Shuttleworth |
| 2014/0317845 to Smith |
| 2015/0074906 to Hiatt et al. |

Brockhaus discloses a waterbed mattress pad which is removably attachable through use of a zipper.

Limb et al. disclose an insulating coverlet for waterbeds that includes downwardly depending straps 16 as is conventional.

Thornhill discloses a contoured sheet in which crossed straps are attached on the underside to secure it.

Hollander discloses a mattress cover including corner straps as seen, for example, in FIGS. 1 and 5, to secure the cover.

Finn discloses a mattress protector having a moisture proof layer 25 releasably attachable to the remaining structures of the protector 10 using releasable fasteners such as zippers, hook and loop fasteners, or snaps (column 3, lines 1-5).

Marrache discloses a mattress cover that encloses a mattress and includes an upper fabric layer 42 that is removably secured to an underlying waterproof cover 20 through the provision of a zipper or other diverse fasteners as explained in the paragraph at column 3, beginning at line 30.

Malouf et al. disclose a mattress protector including the ability to also enclose an underlying box spring and which is closed with a zipper. It does not appear the upper portion is removable.

Poston discloses an integrated mattress encasing that includes a topper 102 fastened with a peripheral zipper 204. Another embodiment discloses a topper 102 fastened with a zipper 104.

Sack discloses a fitted sheet in which embodiments of fastening straps are included.

Taylor discloses a bed clothing assembly in which peripheral straps are employed to hold a panel area 86 in place.

Shuttleworth discloses a bed sheet system in which a top waterproof inlay is removed through operation of a zipper 16. Elastic strips allow adjustment for mattresses of differing thicknesses.

Smith discloses a mattress cover of general relevance.

Hiatt et al. disclose an incontinence bed cover in which the cover has downwardly depending elastic straps in its corners.

The present invention patentably distinguishes from the teachings of all of the prior art known to Applicants by providing a unique combination of elements, namely, a mattress protector that fully encloses a mattress, the mattress protector being fluid impervious, the mattress protector incorporating features to prevent bed bugs or other insects or parasites from escaping the mattress protector, a mattress protector having a top wall with a mattress pad incorporated therein and which is removable and replaceable with respect to the rest of the mattress protector, and wherein supports are provided for the side walls of the mattress protector so that they remain upright when the top wall is removed for washing or other purposes.

SUMMARY OF THE INVENTION

The present invention relates to a mattress protector with removable top and having side supports. The present invention includes the following interrelated objects, aspects and features:

(1) In a first aspect, the present invention consists of a mattress protector which is designed to completely enclose a mattress. When doing so, the inventive mattress protector essentially hermetically seals the mattress from outside the protector.

(2) The mattress protector is made of materials that facilitate hermetically sealing the mattress. Those materials include materials designed to resist the bites of bed bugs trying to escape the enclosure of the mattress protector. Thus, in one aspect, the material of the bottom wall and side walls may, if desired, consist of a polyester knit lined with a polyethylene film. The top wall may be made of a 60% polyester/40% modal circular knit laminated with a breathable thin TPU. The top wall may also have attached to the top surface facing the user a quilted layer that may also be filled with a down fiber fill. If desired, the top surface of the top wall may be provided with a coating providing temperature responsive moisture transport properties.

(3) The top wall is removable from the side walls by virtue of a zipper extending all the way around the top wall and the combination of all of the side walls. In the preferred embodiment, the zipper includes protective features designed to prevent bed bugs from leaving the interior of the mattress protector via the zipper slide. Such features can include a flap attached over the zipper slide when it is at the end of its travel with the flap having one-half of a hook and pile fastening means preferably sold under the trademark VELCRO® with the other half of the hook and pile fastening means being located on either the top wall or one of the side walls or some combination of both.

(4) In an important feature of the present invention, when the top wall is removed from the side walls, in prior art mattress protectors, the side walls collapse downward so that they are spaced from their configuration when the top wall is attached. This makes it extremely difficult to reattach the top wall as the zipper can easily bind, catch adjacent fabric, and become damaged or inoperable. To solve this problem, the present invention includes supports for the side walls so that when the top wall is removed, the side walls remain erect so that the top wall can easily be reattached by placing the top wall over the top surface of the mattress and then operating the zipper around the side walls to reattach the top wall.

(5) Installing the mattress protector on the mattress is easy to do. The top wall is removed, the mattress is placed within the bottom wall and side walls of the mattress protector, and then the top wall is attached thereover using the side supports to hold the side walls upright and then operating the zipper about the circumference of the top of the side walls to reattach the top wall.

(6) As will be described in greater detail hereinafter, the present invention contemplates a number of different embodiments of structures designed to hold the side walls upright when the top wall is removed. These different embodiments are described in detail hereinafter.

As such, it is a first object of the present invention to provide a mattress protector with removable top and side supports.

It is a further object of the present invention to provide such a mattress protector which provides a sealed enclosure for a mattress that prevents escape of beg bugs and incursion of liquids.

It is a yet further object of the present invention to provide such a mattress protector in which the top wall is completely removable for washing.

It is a yet further object of the present invention to provide such a mattress protector in which a mattress pad is incorporated into the top wall of the mattress protector.

It is a still further object of the present invention to provide such a mattress protector in which supports are provided for the side walls so that they remain upright when the top wall has been removed for washing.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
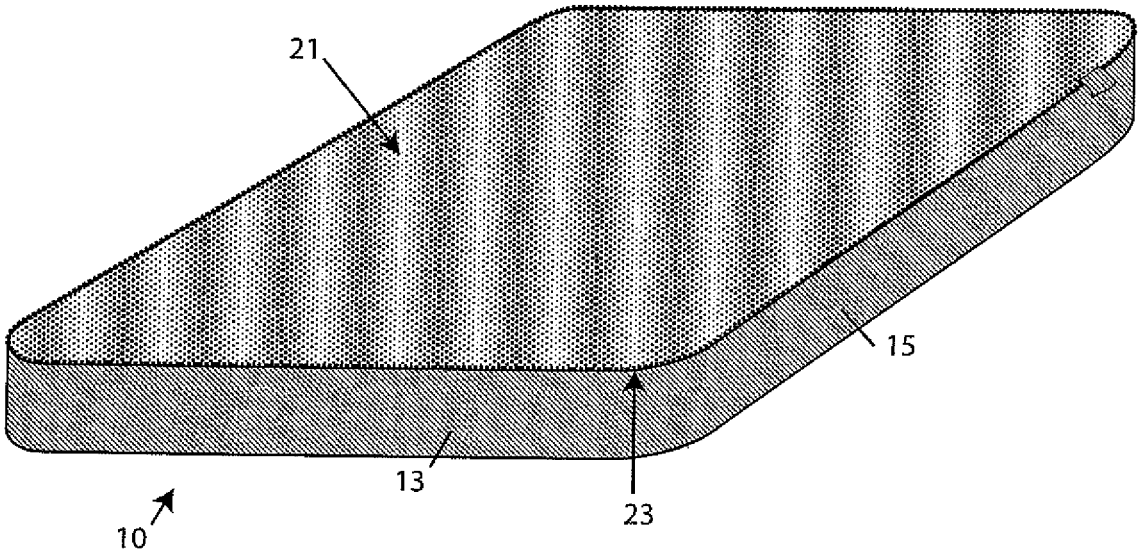
FIG. 1 shows a perspective view of the present invention as mounted over a mattress.
Figure 2:
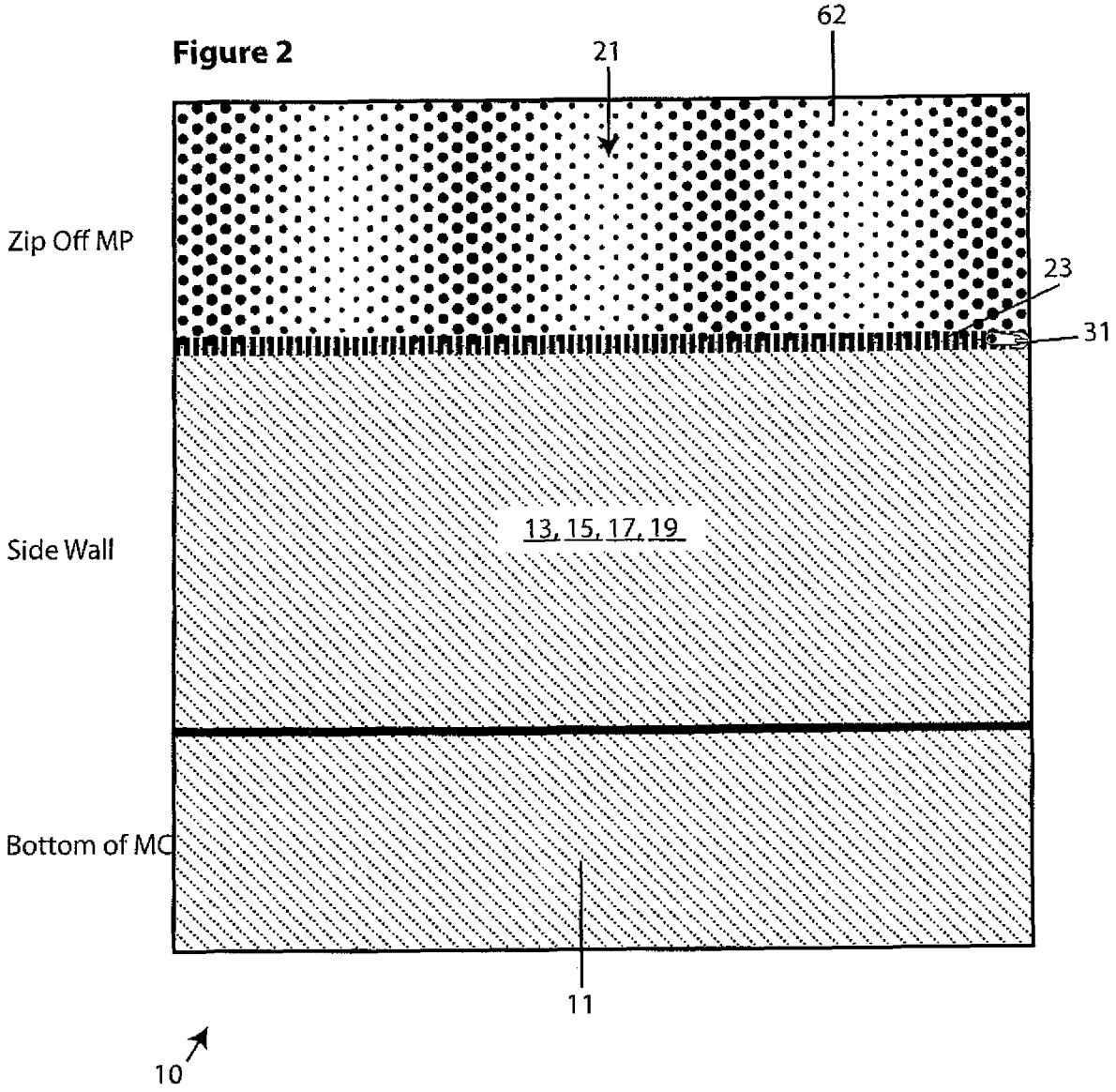
FIG. 2 shows a view of the top wall, side wall, and bottom wall unfolded to show details.
Figure 6:
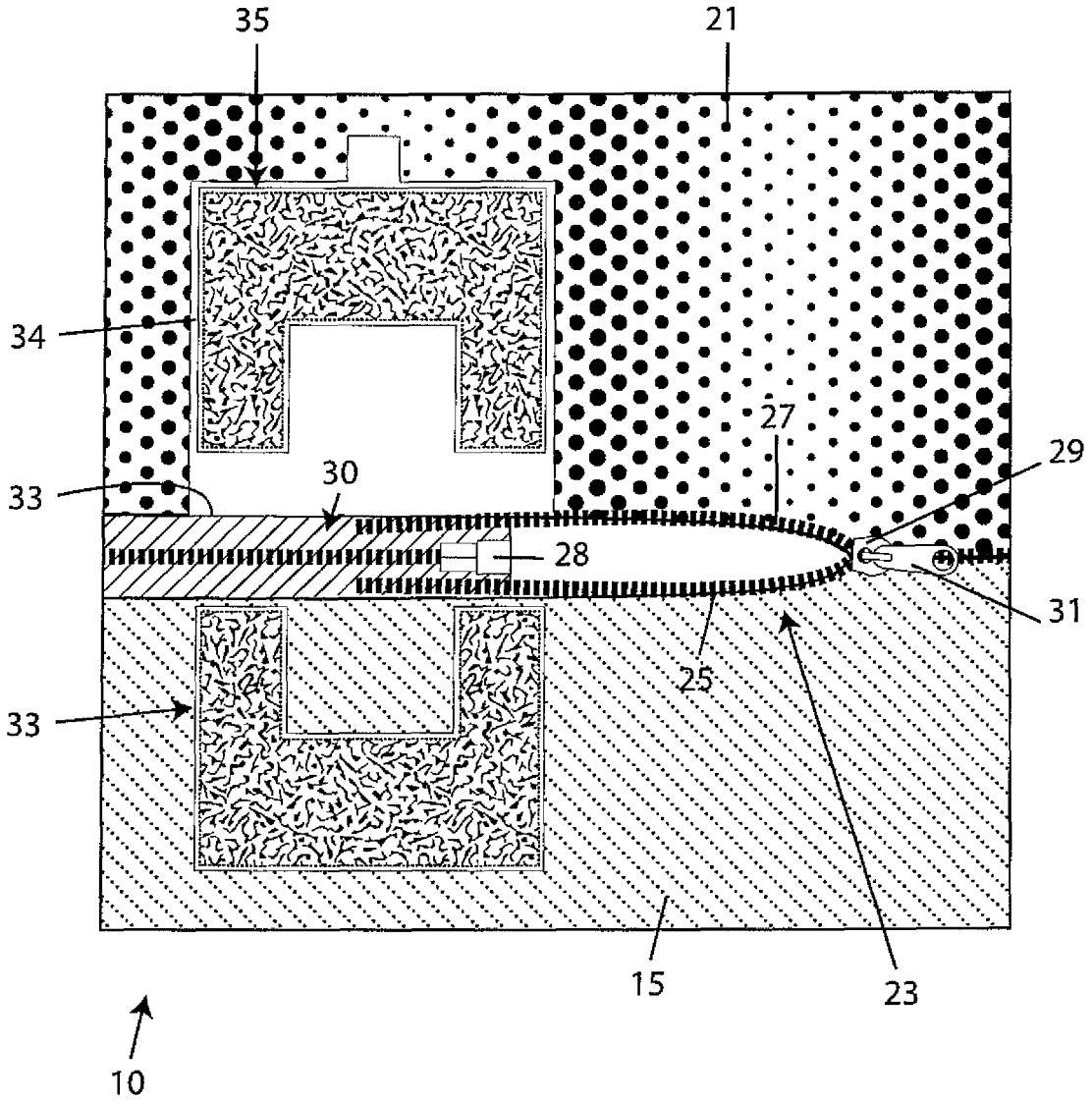
FIG. 6 shows a detailed view of the zipper track sealing structure of FIG. 5.
Figure 8:
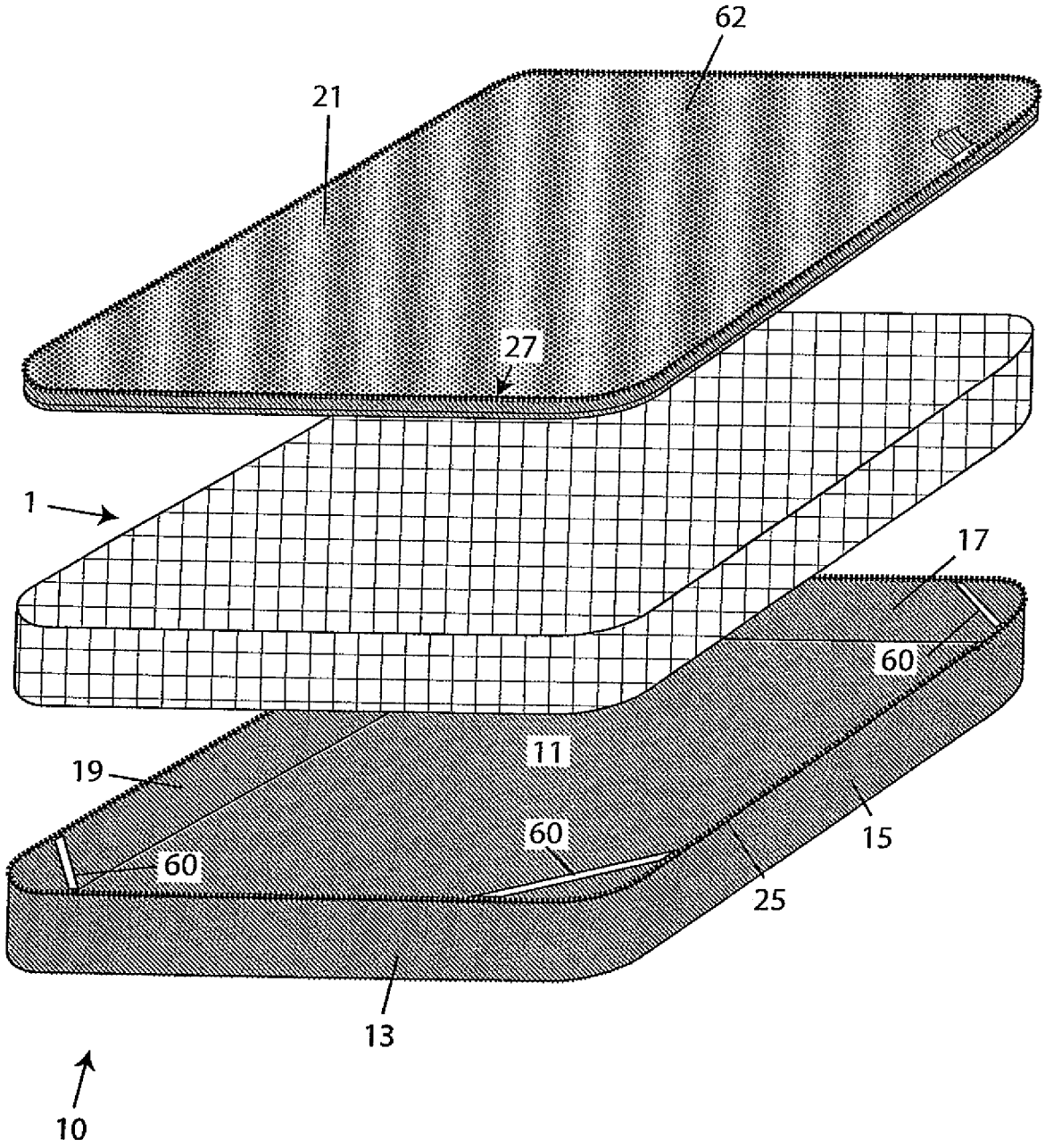
FIG. 8 shows the present invention with its top removed in exploded configuration showing a first embodiment of straps designed to hold the side walls upright.
Figure 9:
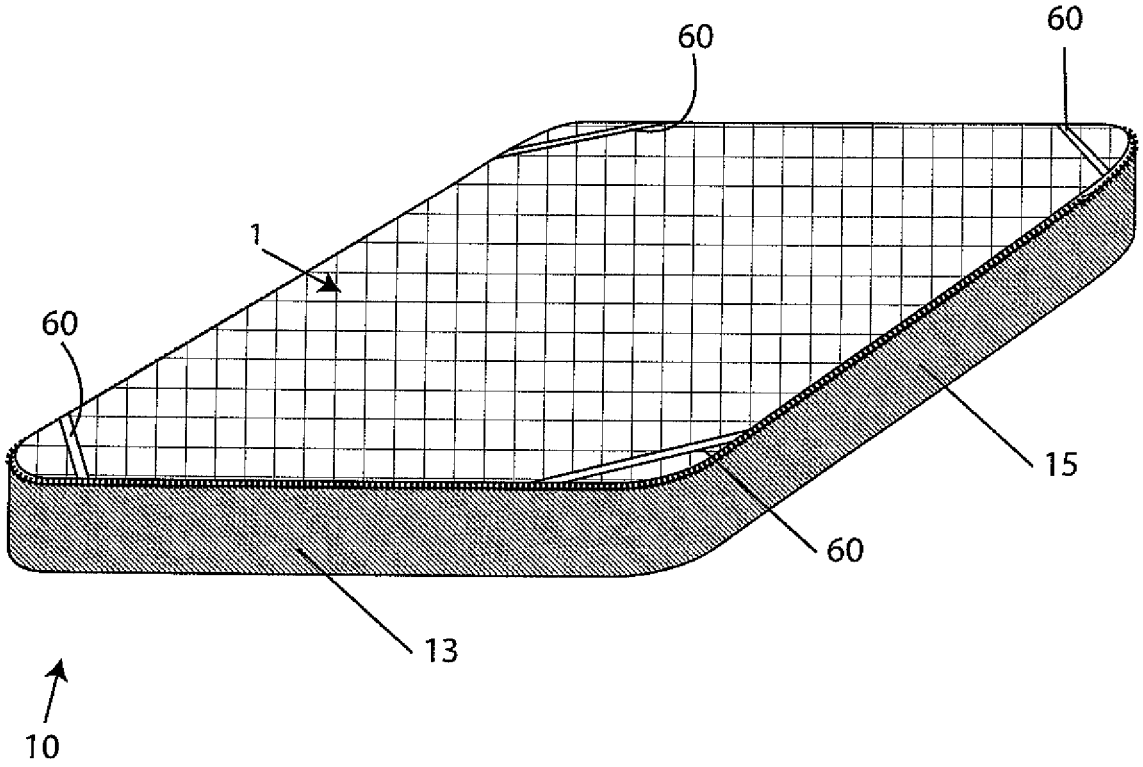
FIG. 9 shows a view similar to that of FIG. 8 but with the top wall removed to reveal more details.

With reference to FIGS. 1 and 9, the present invention is generally designated by the reference numeral 10 and is seen to include a bottom wall 11 (FIG. 9), side walls 13, 15, 17 and 19, and a top wall 21 (FIG. 1). As seen in FIG. 9, one half 25 (FIG. 9) of a zipper 23 (FIG. 1) surrounds the uppermost extents of the side walls 13, 15, 17 and 19. The other half 27 of the zipper 23 extends about the periphery of the top wall 21 (FIG. 8). With reference to FIG. 6, the zipper 23 has a slide 29 to which is attached a pull 31 that allows the slide 29 to be moved to zip up or unzip the zipper 23. One end of the zipper is designated by the reference numeral 28 and the other end is designated by the reference numeral 30 and slightly overlaps the end 28 for a purpose to be described in greater detail below.

Figure 5:
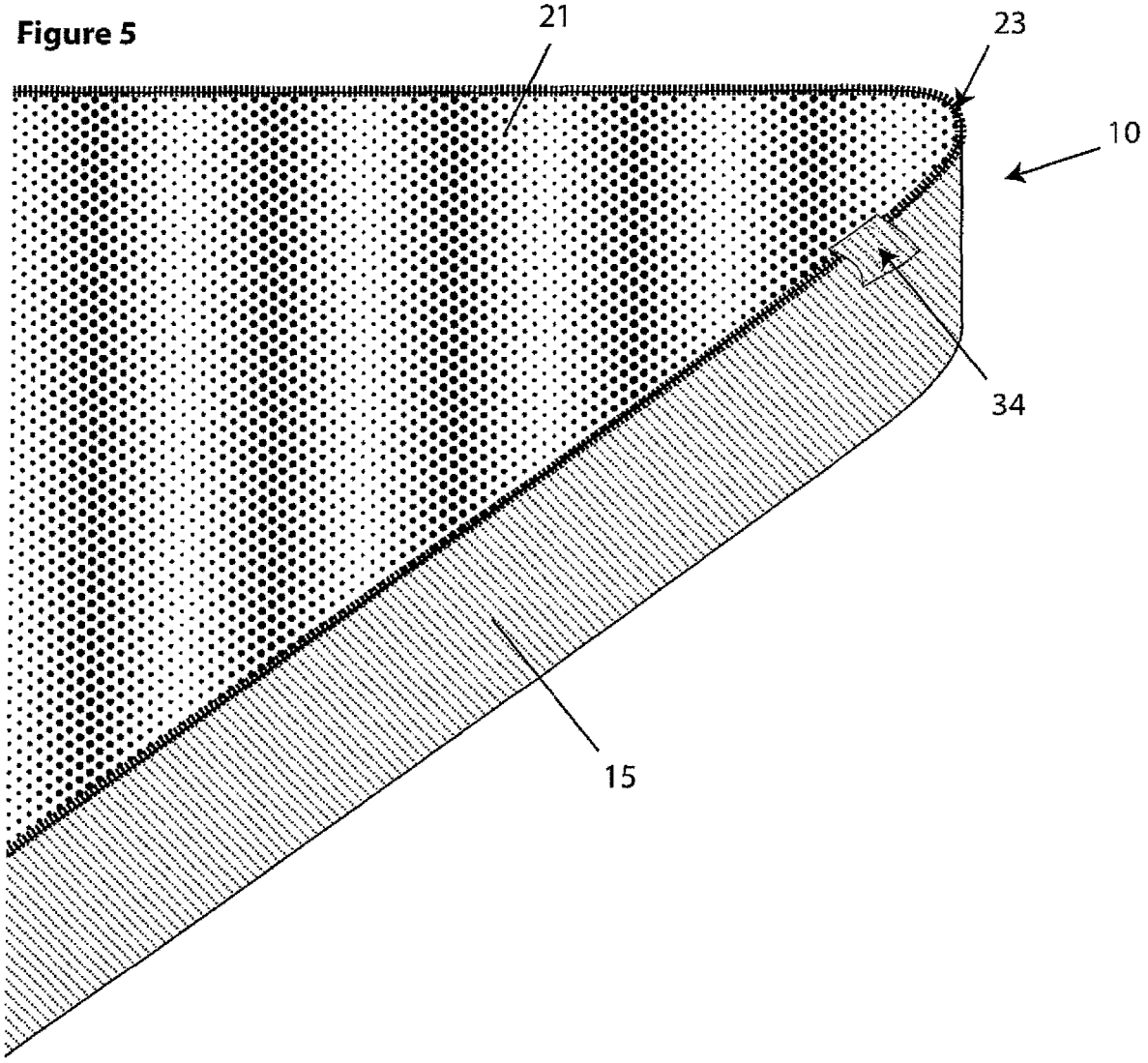
FIG. 5 shows a view of the structure for sealing the end of the zipper track.
Figure 7:
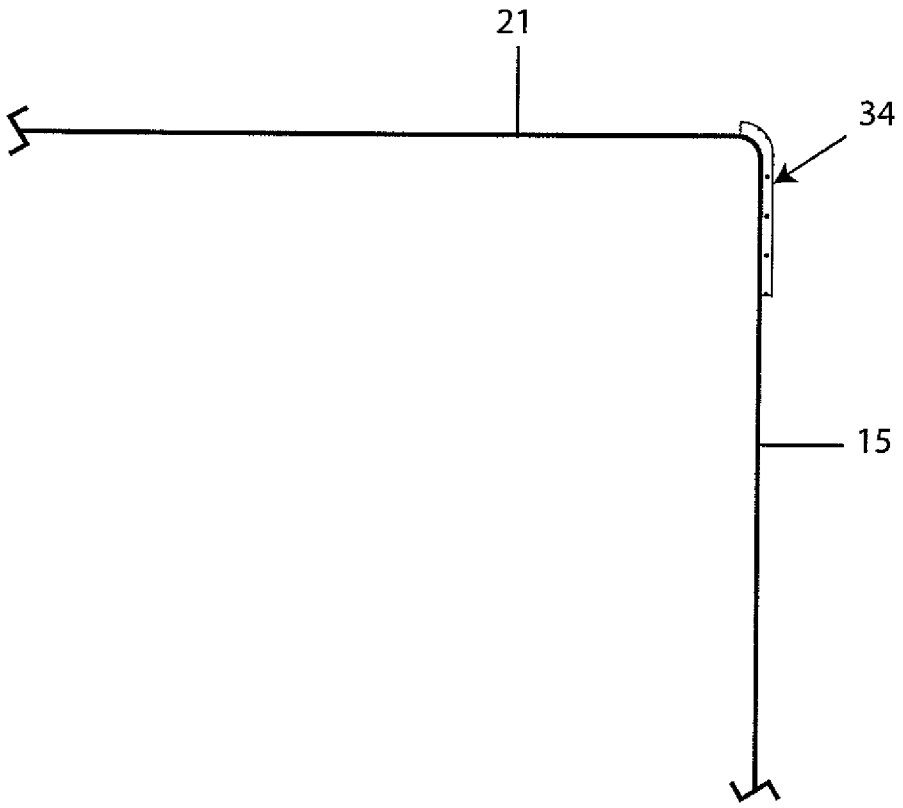
FIG. 7 shows a side view of the preferred configuration of the zipper flap.

As also shown in FIGS. 5-7, a C-shaped area 33 consists of one half of a hook and pile fastening means, for example, as sold under the registered trademark VELCRO®. That half is affixed to the side wall 15 of the mattress protector 10 by any suitable means including stitching or adhesive, among others. Vertically aligned with the half 33 is the other half 35 which is mounted on a pivotable flap 34 attached to the top wall 21 of the mattress protector 10 by means including, for example, stitching at the seam 39. Thus, when the slide 29 has been moved so that the entire zipper 23 is closed and the slide is at a location overlying the end 28 of the zipper 23, the flap 34 may be pivoted so that the hook and pile fastening halves 33 and 35 engage one another to seal the ends 28, 30 of the zipper to prevent bed bugs from escaping from the interior of the mattress protector 10.

Figure 3:
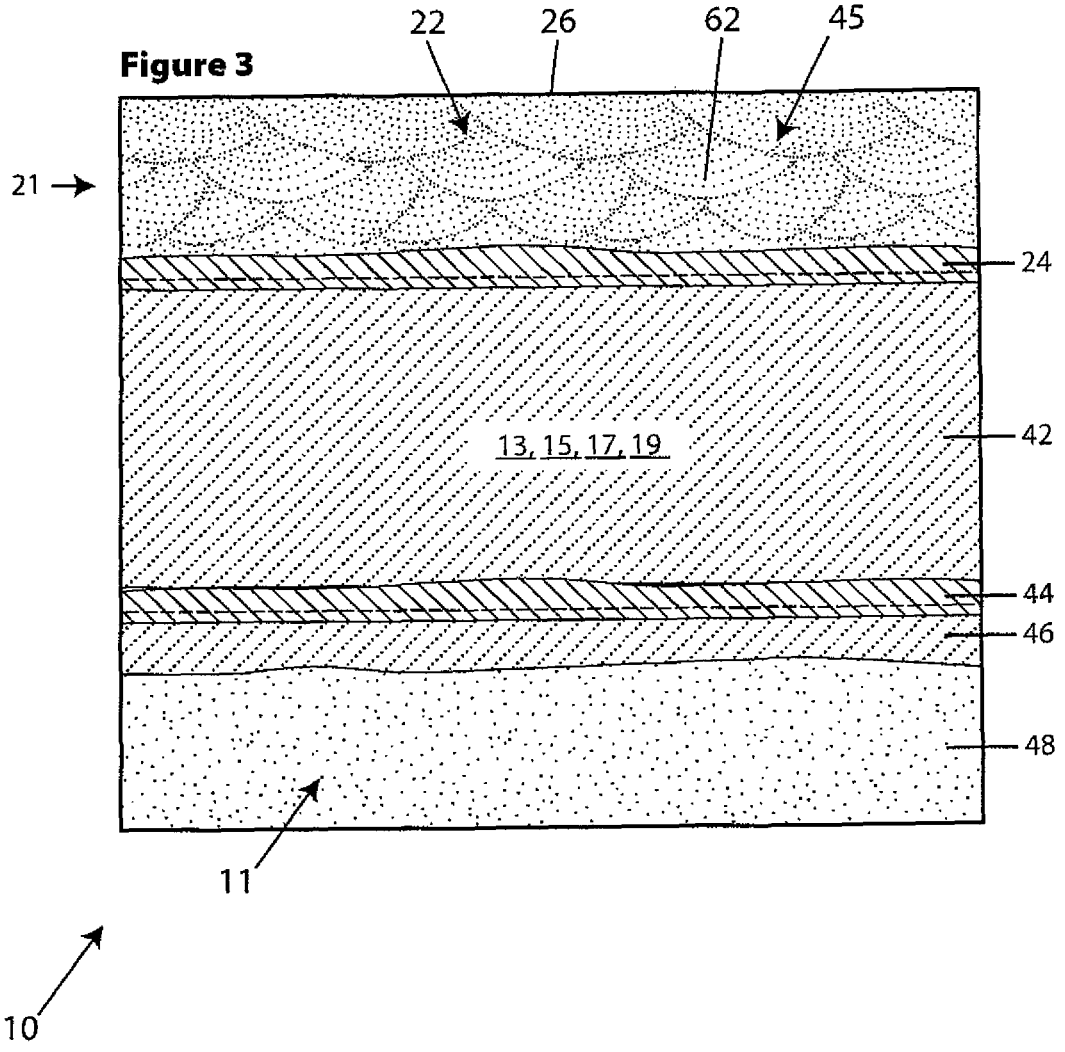
FIG. 3 shows a view similar to that of FIG. 2 showing structures of the present invention.

With reference to FIG. 3, it is seen that the top wall 21 of the mattress protector 10 consists of a top portion 22 preferably made of 60% polyester/40% modal circular knit to provide a mattress pad aspect and this aspect is preferably laminated to a breathable finished TPU 24. The material 22 may, if desired, be filled with a fiber fill made of down for warmth and insulation and may be hypoallergenic. The top surface 26 of the layer 22 may, if desired, be quilted in any desired quilting pattern such as a hexagonal pattern and may be provided with an adaptive finish, if desired.

Figure 10:
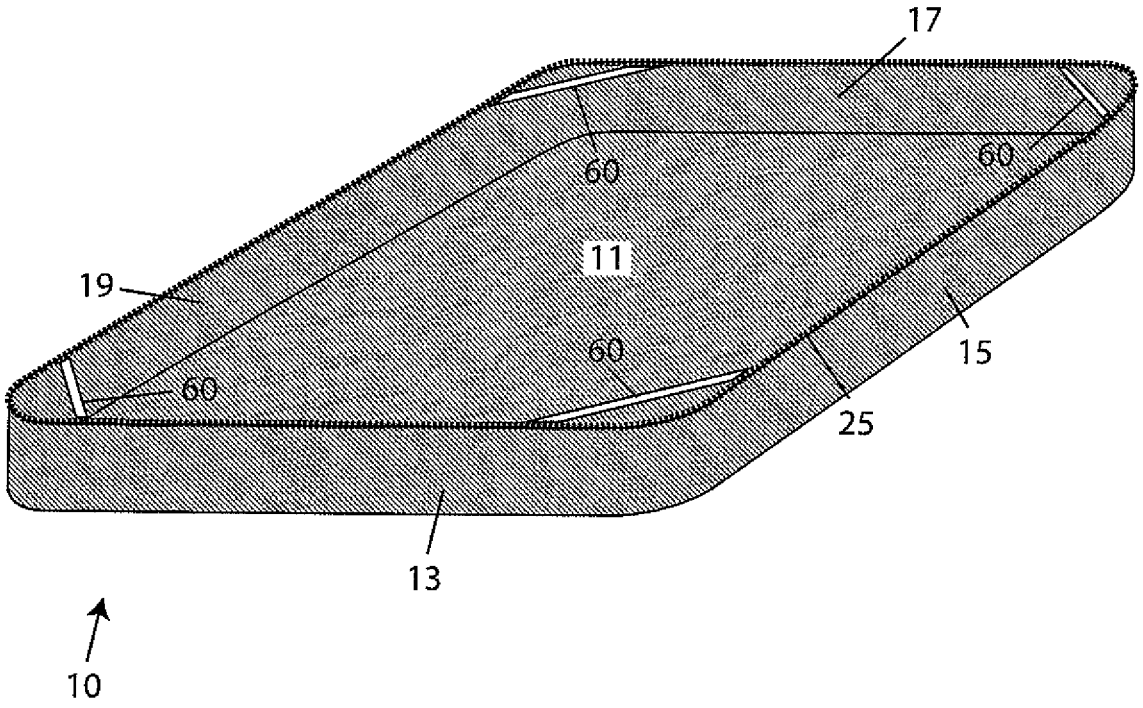
FIG. 10 shows a view similar to FIGS. 8 and 9 but with the mattress removed to show more details.

With further reference to FIG. 10, the side walls 13, 15, 17 and 19 may preferably be made of a 100% polyester knit with a polyethylene film laminated to the interior. The knit is designated by the reference numeral 42 and the polyethylene film is designated by the reference numeral 44. The same materials may be used in fabricating the bottom 11, a 100% polyester knit 46 to which is laminated a polyethylene film 48.

Figure 4:
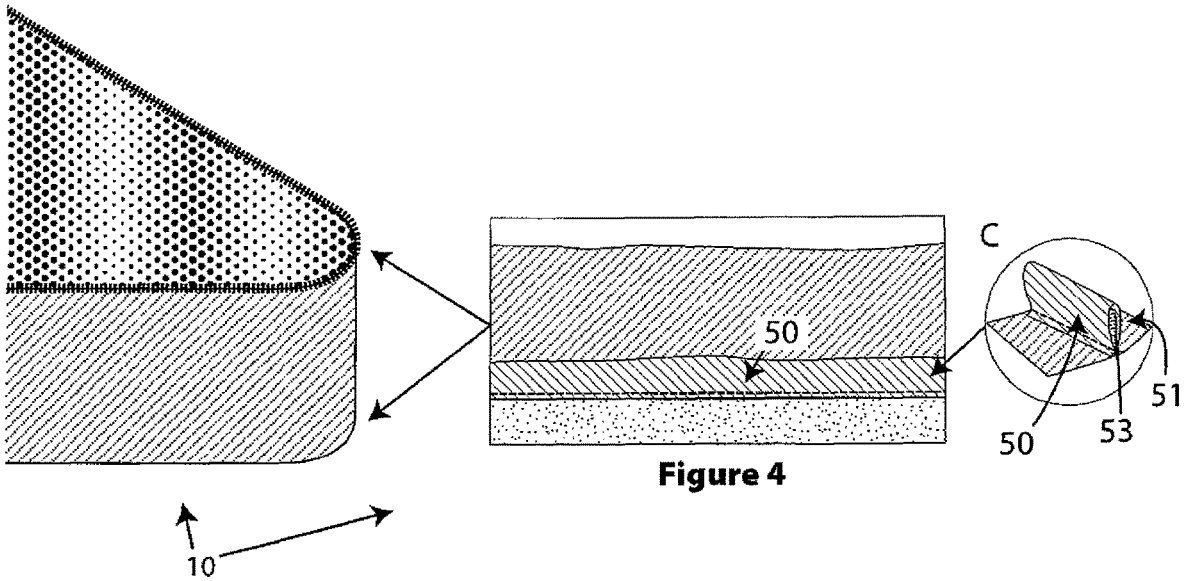
FIG. 4 shows a detailed view of a seam designed to preclude bed bug escape.

With reference to FIG. 4, a detail of a seam 50 is shown. As seen, the seam 50 has a loop 51 that is closed and sealed at 53. This structure is specifically designed to prevent bed bug escape An important aspect of the present invention concerns the desire to ensure that when the top wall 21 is removed from the side walls 13, 15, 17 and 19 of the mattress protector 10 by operating the zipper 23, the side walls remain erect until the top wall has been restored to its installed configuration. It is desirable to periodically remove the top wall 21 from the rest of the mattress protector so that the top wall which comes in contact with the sheets and pillow cases of the user may be laundered. Thus, with reference first to FIGS. 8-9, a first embodiment of a device to hold the side walls 13, 15, 17 and 19 erect is shown. In particular, at each corner of the mattress protector 10 at the intersection of adjacent side walls, an elastic strap 60 is provided. When the mattress protector 10 is installed on a mattress 1, the straps 60 may be stretched when the mattress 1 is being inserted within the side walls and then may overlie the corners of the mattress 1 to hold the side walls erect in the configuration shown in FIG. 8 when the top wall 21 has been removed. As clearly seen in FIG. 9, when the mattress protector 10 is installed over a mattress 1, its side walls 13, 15, 17 and 19 are closely adjacent to and, in fact, engage outer surfaces of the mattress 1.

Figure 11:
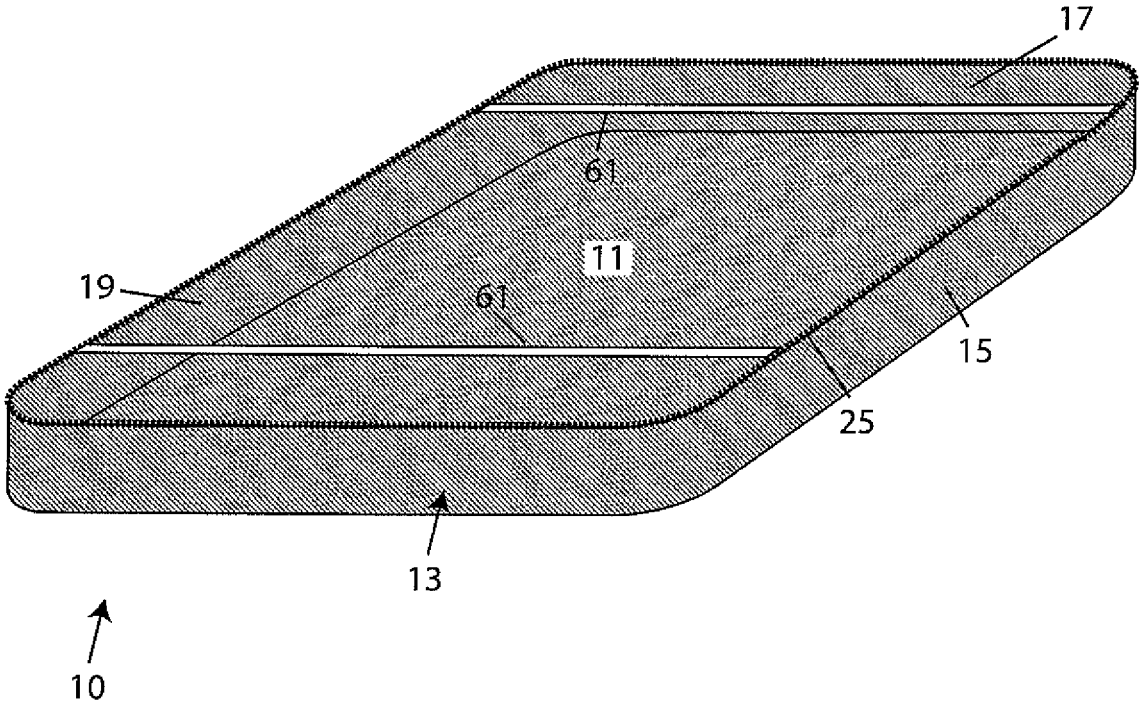
FIG. 11 shows a further embodiment of side wall supporting straps.

FIG. 11 shows the mattress protector 10 with the top wall 21 removed to allow better visibility. In the embodiment shown in FIG. 11, the corner straps 60 have been replaced by straps 61 which extend in spaced relation to one another across the shorter dimension of the mattress protector 10. These straps overlie the mattress (not shown in FIG. 11) when the mattress is inserted within the mattress protector so that the side walls are held erect when the top wall 21 is removed therefrom. As shown, the straps 61 extend between the opposed walls 15 and 19. If desired, one or the other end of each strap 61 may have a releasable fastener allowing it to be disconnected from the walls 15 and 19 while the mattress is being inserted and then may be reconnected to perform the function of holding the side walls erect in the manner shown in FIG. 11.

Figure 12:
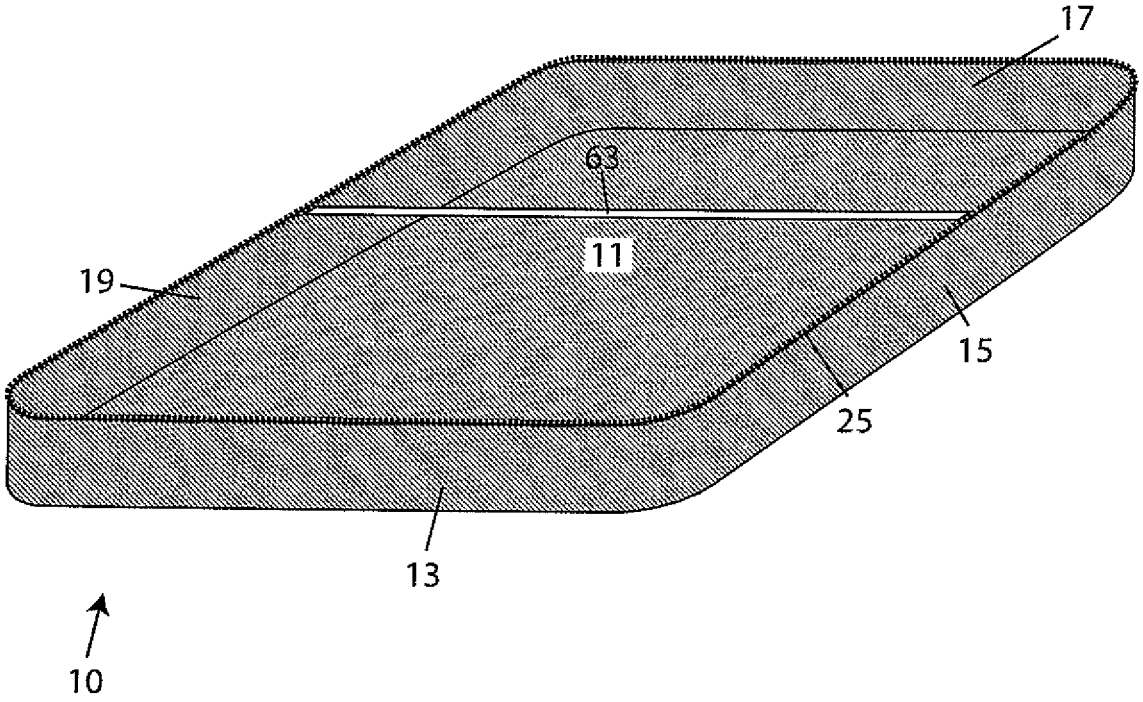
FIG. 12 shows a single strap used to support the side walls.

With reference to FIG. 12, a single strap 63 may extend between the walls 15 and 19 to hold the side walls erect. As described above, one or the other or both ends of the straps 63 may be releasable from the walls 15 or 19 or hook and pile fastening means may be employed to best facilitate installation of the mattress. The fasteners described below with reference to FIGS. 18 and 19 may be employed.

Figure 13:
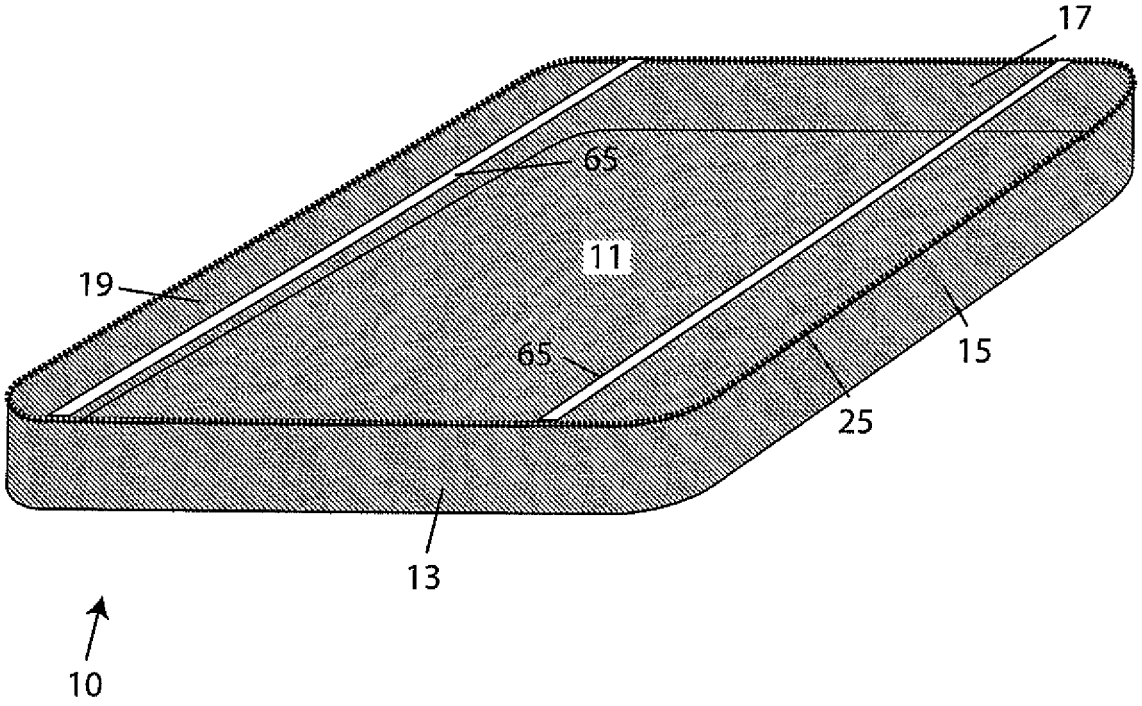
FIG. 13 shows a further example of longitudinally extending straps designed to hold up the side walls.
Figure 14:
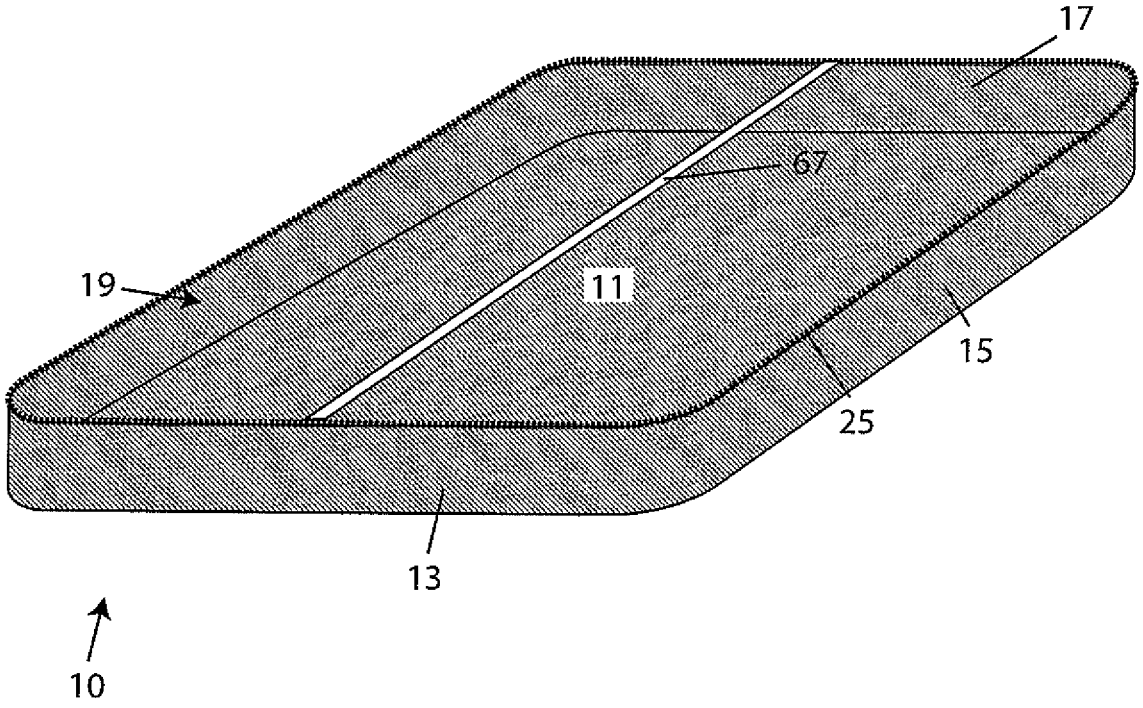
FIG. 14 shows a further embodiment showing a single longitudinal strap designed to hold up the side walls.

With reference to FIG. 13, straps 65 extend between the walls 13 and 17 along the longer dimension of the mattress protector 10. As explained above, the straps 65 may have their ends able to disconnect from the walls 13 and 17 (see FIG. 18) or hook and pile fastening means may be employed (see FIG. 19) to facilitate installation of a mattress whereupon they may be reconnected to perform the function of holding the side walls 13, 15 17 and 19 erect when the top wall 21 has been removed. FIG. 14 shows a single strap 67 extending between the walls 13 and 17 and may, if desired, be detachable from the walls 13 and 17 to best facilitate insertion of a mattress whereupon the strap 67 may be reconnected to hold the side walls erect when the top wall 21 has been removed.

Figure 15:
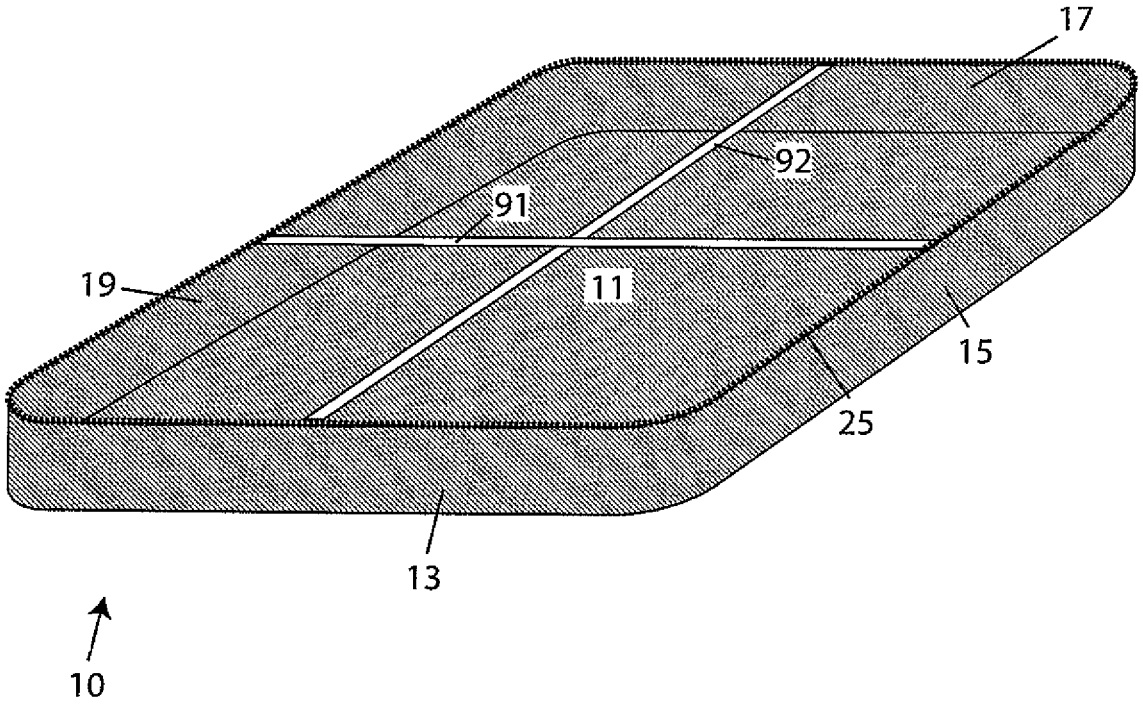
FIG. 15 shows a further embodiment showing crossed straps designed to hold up the side walls.

With reference to FIG. 15, a strap 91 extends between the walls 15 and 19, and another strap 92 extends between the walls 13 and 17. As seen in FIG. 15, these straps are crossed. While FIG. 15 shows the strap 91 overlying the strap 92 where they cross, the reverse configuration is equally feasible. As should be understood, where the configuration of the straps 91 and 92 is employed, at least one end of each of the straps must be made removable from a side wall to facilitate placement of a mattress within the protector 10.

Figure 18:
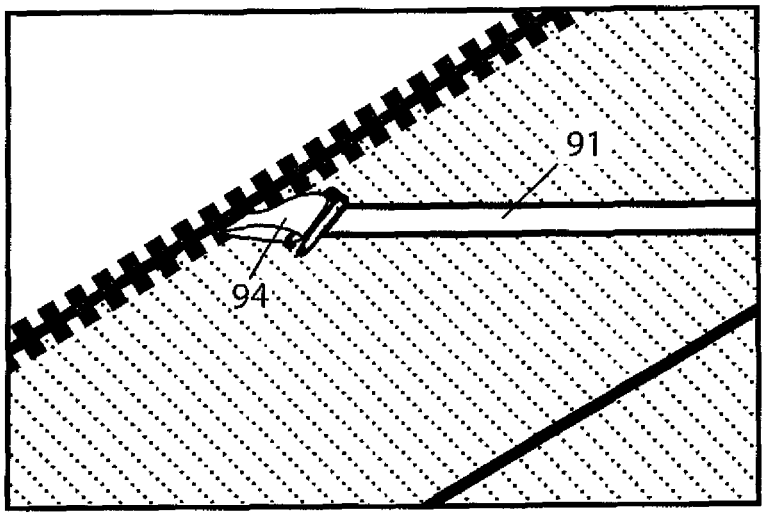
FIG. 18 shows a first embodiment of fastener permitting attachment of crossed straps.
Figure 19:
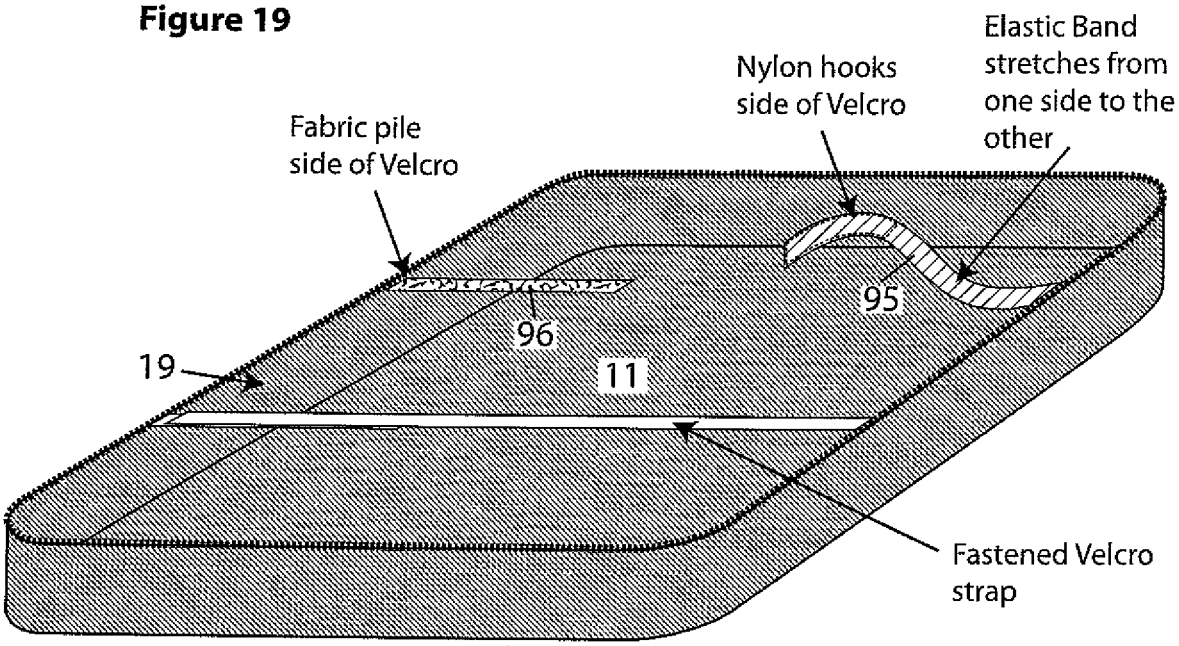
FIG. 19 shows a second embodiment of fastener permitting detachment of crossed straps.

Thus, reference is now made to FIGS. 18 and 19 which show two different embodiments facilitating removal of an end of a strap. Thus, with reference first to FIG. 18, the strap 91 is representative of the straps 91 and 92 concerning this feature. As shown in FIG. 18, at one end of the strap 91, a clip 93 is provided which has a slot with a side opening. A loop 94 is fastened to the adjacent side wall and the clip may easily be slid laterally to detach the strap 91 from the side wall.

With reference to FIG. 19, in another embodiment, the straps 91 and 92 may be made of the halves of a hook and pile fastening means. Thus, the reference numeral 95 shows the hook half while the reference numeral 96 shows the pile half. As shown, these halves are easily detachable to permit placement of the mattress, whereupon they may be reattached to perform the desired functions of the present invention.

Figure 16:
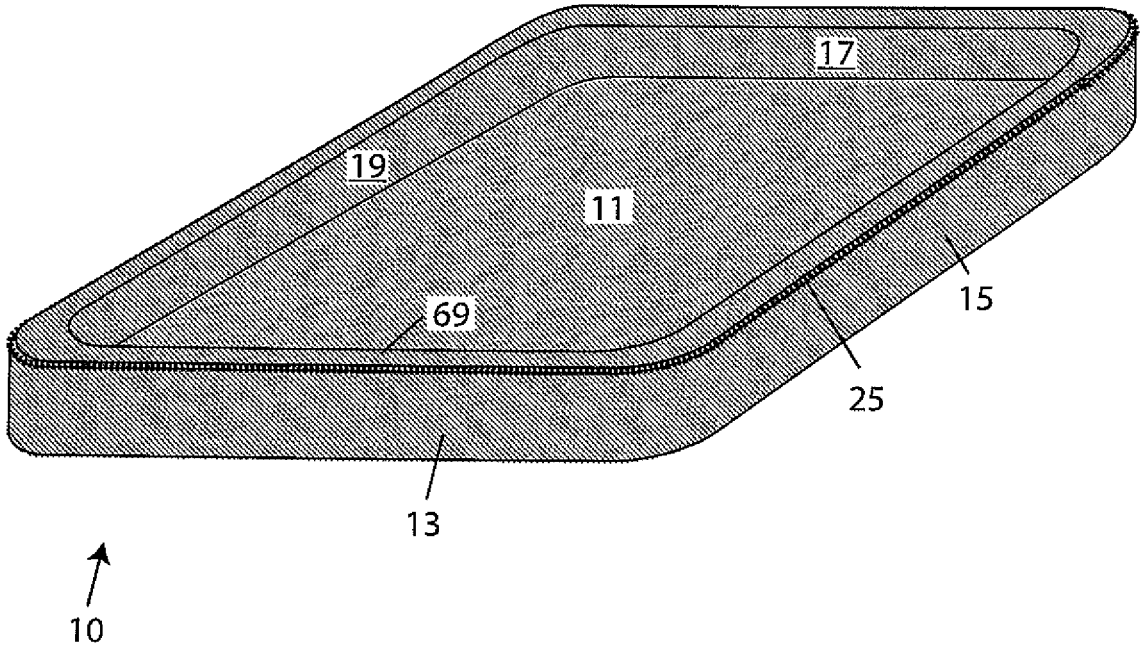
FIG. 16 shows an overlaying surface inboard of the zipper half of the side walls designed to hold the side walls upright when the top wall is removed.

With reference to FIG. 16, the side walls 13, 15, 17 and 19 may have horizontal inwardly extending elastic extensions designated by the common reference numeral 69 which are made of a flexible elastic material that permits the aspect 69 to be folded out of the way of a mattress being installed within the mattress protector 10 whereupon it may be flipped back to overlie the top periphery of the mattress in the configuration shown in FIG. 16 to facilitate holding the sides 13, 15, 17 and 19 erect when the top wall 21 has been removed therefrom.

Figure 17:
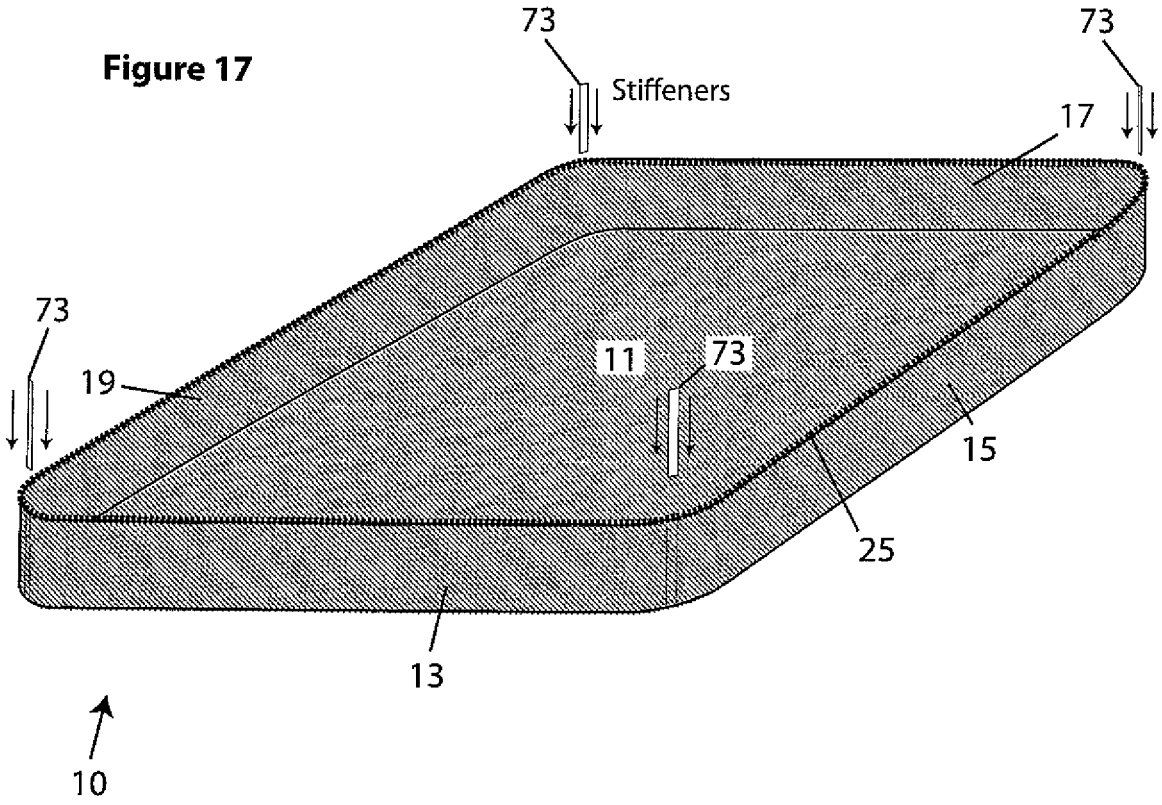
FIG. 17 shows stiffeners received in recesses in the corners of the side walls designed to hold the side walls upright.

Finally, with reference to FIG. 17, the mattress protector 10, side walls 13, 15, 17 and 19 may have pockets 71 at corners where adjacent side walls intersect. Stiff elongated members designated by the reference numeral 73 and preferably made of hard plastic or metal may be inserted in the pockets 71 to facilitate holding the side walls 13, 15, 17 and 19 erect in the manner shown in FIG. 17 when the top wall 21 has been removed from the rest of the mattress protector 10. The stiffeners 73 may be permanently inserted within the pockets 71 or may be removable therefrom when it is desired to launder the entire mattress protector if such is desired.

The zipper 23 may be made of plastic or, if desired, may be made of metal coated with plastic. Preferably the zipper does not have exposed metal except perhaps the slide 29 or pull 31 because the environment of a mattress protector and mattress may be somewhat humid and rusting could occur.

Additionally, the top surface 62 of the top wall 21 of the inventive mattress protector 10 may be provided with a novel hydro-functional polymer film described as HeiQ® Adaptive, also disclosed in the Marte et al. Published Application. The HeiQ® Adaptive polymer film is possessed of temperature responsive moisture transport properties. Thus, for example, at temperatures greater than 30° C., at which cooling is desirable, its wetting and evaporation are enhanced. At lower temperatures such as below 30° C., when cooling is less needed, wetting and evaporation are reduced. The cooling properties are based upon facilitating evaporation of moisture emitted from the skin of a person occupying the associated bed.

In more detail, the temperature responsive polymer film binds to water at lower body temperatures such as below 30° C. and precipitates water at higher temperatures due to the increasing insolubility. Since the released water more or less quickly evaporates corresponding to the prevailing conditions and energy is removed by the evaporation enthalpy that is to be applied to the system, the result is cooling of the wall 21, particularly its top surface, and thus the skin of the person or persons occupying the associated bed.

Figure 20:
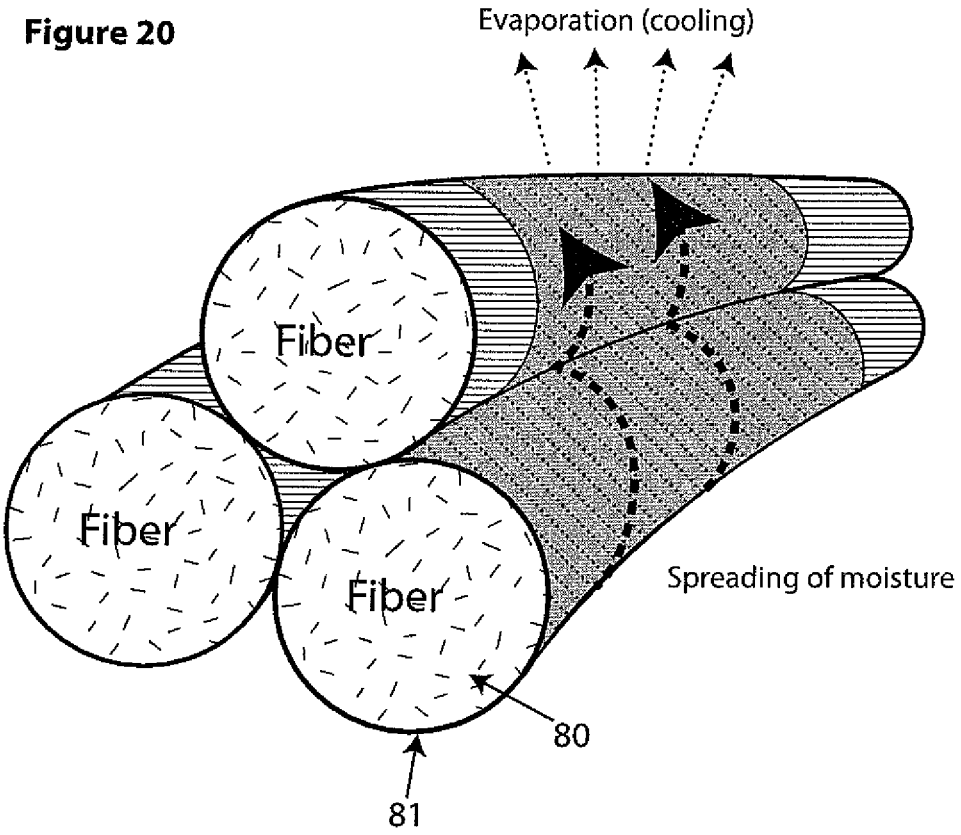
FIG. 20 shows a schematic representation of a coating that may be incorporated into the inventive mattress protector to provide temperature responsive moisture transport properties.

FIG. 20 shows an enlarged view of a portion of the textile employed for the top wall 21 of the inventive mattress protector 10. In FIG. 20, the reference numeral 80 refers to one of the numerous fibers woven to form the top wall 21. The reference numeral 81 refers to the coating of the hydro-functional polymer film and anti-microbial coating which as clearly seen envelop the entirety of the external surfaces of the fibers 80 and thereby encloses them and isolates them from the atmosphere so that it is the coating 81 itself that is exposed to ambient temperature conditions, conditions of sweat and liquid, and other ambient conditions.

The present invention provides a mattress protector 10 including a variety of embodiments of structures to maintain the side walls erect when the top wall has been removed which is waterproof, provides an allergen barrier, provides a barrier to exit of bed bugs, is made of interior lining materials that are bite proof from bed bugs. If desired, temperature regulating materials may be utilized particularly for the fabric 22 of the top wall 21. Additionally, the fabrics may be provided with an anti-microbial coating or may be made of an anti-microbial material which is designed to prevent migration of microbes.

As such, an invention has been disclosed in terms of preferred embodiments thereof which fulfill each and every one of the objects of the invention as set forth hereinabove, and provide a new and useful mattress protector with removable top and side supports of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A mattress protector, comprising:

a) a bottom wall, side walls and a top wall combining together to completely enclose a mattress with said side walls closely adjacent to said mattress;

b) a closure connecting said top wall to said side walls, said top wall being removable from said side walls when said closure is opened;

c) a device attached to said side walls at discrete spaced locations, said device maintaining said side walls upright when said top wall is removed therefrom; and d) said top wall having a top surface provided with a hydro-functional polymer film possessing temperature responsive moisture transport properties.

2. The mattress protector of claim 1, wherein said closure comprises a zipper.

3. The mattress protector of claim 2, wherein said zipper has first and second ends, said first end being closed and said second end being opened when said zipper is opened.

4. The mattress protector of claim 3, wherein said zipper has a slide movable to open and close said zipper, said slide moving past said first end prior to completely closing said zipper.

5. The mattress protector of claim 4, wherein when said slide arrives at said second end, a flap may be pivoted over said first and second ends of said zipper to seal an interior of said mattress protector.

6. The mattress protector of claim 1, wherein said device comprises a strap connected between opposed side walls.

7. The mattress protector of claim 6, wherein said strap comprises a first strap, and further including a second strap connected between said opposed side walls.

8. The mattress protector of claim 7, wherein said side walls comprise a first pair of opposed relatively shorter in length side walls and a second pair of opposed relatively longer in length side walls.

9. The mattress protector of claim 8, wherein said straps extend between said first pair of side walls.

10. The mattress protector of claim 8, wherein said straps extend between said second pair of side walls.

11. The mattress protector of claim 1, wherein said device comprises a first strap connected between a first pair of adjacent side walls and a second strap connected between a second pair of adjacent side walls.

12. The mattress protector of claim 1, wherein said device comprises an inwardly extending lip interconnecting said side walls and overlying a periphery of a top wall of a mattress within said mattress protector.

13. The mattress protector of claim 1, wherein said device comprises a stiffener installed between adjacent side walls.

14. The mattress protector of claim 13, wherein said stiffener comprises a stiff elongated member inserted into a pocket at an intersection of adjacent side walls.

15. The mattress protector of claim 14, further including a pocket at each corner of said mattress protector, and a stiff elongated member received in each pocket.

16. The mattress protector of claim 1, wherein said device comprises two crossed straps.

17. The mattress protector of claim 16, wherein each of said crossed straps has an end removably attachable to one of said side walls.

18. The mattress protector of claim 1, wherein said top wall is quilted.

19. A mattress protector, comprising:

a) a bottom wall, four side walls and a top wall combining together to completely enclose a mattress with said side walls closely adjacent to said mattress;

b) a zipper closure connecting said top wall to said side walls, said top wall being removable from said side walls when said closure is opened;

c) a device attached to said side walls at discrete spaced locations, said device maintaining said side walls upright when said top wall is removed therefrom; and d) said top wall having a top surface provided with a hydro-functional polymer film possessing temperature responsive moisture transport properties.

20. The mattress protector of claim 19, wherein said zipper has first and second ends, said first end being closed and said second end being opened when said zipper is opened, said zipper having a slide movable to open and close said zipper, said slide moving past said first end prior to completely closing said zipper.

21. The mattress protector of claim 20, wherein when said slide arrives at said second end, a flap may be pivoted over said first and second ends of said zipper to seal an interior of said mattress protector.

22. The mattress protector of claim 19, wherein said device comprises a strap connected between opposed side walls.

23. The mattress protector of claim 22, wherein said strap comprises a first strap, and further including a second strap connected between said opposed side walls.

24. The mattress protector of claim 19, wherein said side walls comprise a first pair of opposed relatively shorter in length side walls and a second pair of opposed relatively longer in length side walls.

25. The mattress protector of claim 19, wherein said device comprises a first strap connected between a first pair of adjacent side walls and a second strap connected between a second pair of adjacent side walls.

26. The mattress protector of claim 19, wherein said device comprises an inwardly extending lip interconnecting said side walls and overlying a periphery of a top wall of a mattress within said mattress protector.

27. The mattress protector of claim 19, wherein said device comprises a stiffener installed between adjacent side walls.

28. The mattress protector of claim 27, wherein said stiffener comprises a stiff elongated member inserted into a pocket at an intersection of adjacent side walls.

29. The mattress protector of claim 28, further including a pocket at each corner of said mattress protector, and a stiff elongated member received in each pocket.

30. The mattress protector of claim 19, wherein said device comprises two crossed straps.

31. The mattress protector of claim 30, wherein each of said crossed straps has an end removably attachable to one of said side walls.

32. The mattress protector of claim 19, wherein said top wall is quilted.

33. The mattress protector of claim 1, wherein said device comprises straps releasably interconnectable by hook and pile fastening means.

34. The mattress protector of claim 19, wherein said device comprises straps releasably inter connectable by hook and pile fastening means.

* * * * *